US006244895B1

(12) United States Patent
Huang

(10) Patent No.: US 6,244,895 B1
(45) Date of Patent: Jun. 12, 2001

(54) CONNECTOR ASSEMBLY COMPRISING COARSE PITCH CONNECTOR AND FINE PITCH CONNECTOR

(75) Inventor: Wayne Huang, Alhambra, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/454,527

(22) Filed: Dec. 6, 1999

(51) Int. Cl.[7] ..... H01R 13/60; H01R 13/66
(52) U.S. Cl. ..... 439/541.5
(58) Field of Search ..... 439/541.5, 567, 439/607

(56) References Cited

U.S. PATENT DOCUMENTS 5,267,876 * 12/1993 Rupert et al. ..... 439/540
5,643,008 * 7/1997 Tan et al. ..... 439/541.5

* cited by examiner

*Primary Examiner*—Tulsidas Patel
*Assistant Examiner*—Javaid Nasri

(74) *Attorney, Agent, or Firm*—Wei Te Chung

(57) ABSTRACT

An electric connector assembly includes a bracket having a pair of upward-extending arms fixedly receiving a D-sub connector therebetween and a pair of downward-extending legs defining a space for accommodating an ultra-SCSI connector therein. The D-sub connector has first conductive pins of a coarse pitch extending beyond a lower face of the bracket. The bracket forms a pair of first guide posts on the lower face thereof for being inserted into corresponding holes defined in a circuit board to properly align the first pins with corresponding apertures defined in the circuit board. The ultra-SCSI connector has a plurality of second conductive pins extending beyond the lower face. A pair of metallic projections is fixed to the ultra-SCSI connector and extends beyond the lower face for being received in corresponding holes defined in the circuit board to align the second pins with corresponding apertures defined in the circuit board independent of the bracket and the D-sub connector. The projections of the ultra-SCSI connector have a size greater than board locks of a conventional ultra-SCSI connector thereby being capable to sustain an excessive force in mounting the connector assembly to the circuit board. Furthermore, the projections interferentially engage with the corresponding holes for retaining the ultra-SCSI connector on the circuit board preventing the ultra-SCSI connector from floating during a dipping soldering process.

1 Claim, 5 Drawing Sheets

CONNECTOR ASSEMBLY COMPRISING COARSE PITCH CONNECTOR AND FINE PITCH CONNECTOR

BACKGROUND OF THE INVENTION

1. Field of the Invention

The present invention generally relates to an electric connector assembly comprising a bracket accommodating a coarse pitch connector and a fine pitch connector, and in particular to an electric connector assembly allowing effective and proper mounting of the coarse pitch connector and the fine pitch connector thereof to a circuit board.

2. The Prior Art

Electric connector assemblies comprising two or more connectors are known in the art. However, in most applications, connectors comprised of a connector assembly are of substantially the same pitch or having pitches of the same order. Connectors of the same pitches have conductive pins of substantially same order of size, capable of local adjustment in mounting the connectors to a circuit board and bearing mounting forces applied thereto.

Combining connectors that have significantly different pitches, including fine pitch and coarse pitch, in an assembly is rare and represents a question in mounting the connector assembly to a circuit board for a fine pitch connector usually has conductive pins thinner and mechanically weaker than their counterparts of a coarse pitch connector. When mounting the connector assembly to a circuit board, both the fine pitch connector and the coarse pitch connector are subject to the same force which may result, now U.S. Pat. No. 6,074,248 in damage of the weaker pins of the fine pitch connector if they are not properly and precisely aligned with the circuit board during mounting process.

An example of an electric connector assembly comprising a coarse pitch connector and a fine pitch connector is disclosed in the co-pending US patent application Ser. No. 09/176,384 in which a traditional D-sub connector (a coarse pitch connector) and an ultra-SCSI connector (a fine pitch connector) are retained by a bracket. The D-sub connector has a pitch of 2.54 mm, while the ultra-SCSI connector has a pitch of 0.8 mm. The significant difference in pitch between the two connectors hinders smooth and efficient mounting of the electric connector assembly to a circuit board for care must be exercised to properly align the pins of both connectors, especially the fine pitch connector, with the corresponding holes defined in the circuit board.

Connectors for mounting to a circuit board are usually provided with guide posts integrally formed with a housing thereof for guiding the alignment between the connector and the circuit board. Similar to the problem encountered by the conductive pins, the guide posts of a fine pitch connector of a connector assembly are thinner and thus mechanically weaker than a coarse pitch connector of the assembly and do not properly perform the guiding function when the assembly is mounted to the circuit board for the guiding function is substantially taken over by the large posts of the bracket which are of a size corresponding to the coarse pitch connector. For such a reason, the conductive pins of the fine pitch connector are even easier to be subject to damage caused by misalignment.

The connector assembly disclosed in the previously mentioned US patent application Ser. No. 09/176,384 comprises a bracket defining an upper space for receiving and retaining the D-sub connector and a lower space for accommodating the ultra-SCSI connector. The bracket is provided with two guide posts comparable to the D-sub connector and thicker and longer than guide posts of the ultra-SCSI connector whereby during mounting the connector assembly to a circuit board, the guide posts of the bracket becomes dominant in guiding alignment of the connector assembly with the circuit board. However, the guide posts of the ultra-SCSI, due to mechanical weakness, is not capable to properly guide the alignment of the ultra-SCSI connector at the same time when the D-sub connector is aligned with the circuit board.

Meanwhile, the ultra-SCSI is provided with its own board locks for retaining the ultra-SCSI on the circuit board. The board locks, however, further hinder smooth engagement of the pins of the ultra-SCSI connector. However, without the board locks, the ultra-SCSI connector may be floating during a dipping soldering process. This becomes a dilemma.

It is thus desired to provide a connector assembly having guiding means for overcoming the problem discussed above.

SUMMARY OF THE INVENTION

Accordingly, an object of the present invention is to provide an electric connector assembly comprising a coarse pitch connector and a fine pitch connector where the fine pitch connector is provided with enlarged and strengthened guide posts for guiding the alignment thereof with a circuit board.

Another object of the present invention is to provide an electric connector assembly comprising a bracket accommodating a coarse pitch connector and a fine pitch connector wherein the fine pitch connector is provided with retaining projections for retaining the fine pitch connector on a circuit board during a dipping soldering process.

A further object of the present invention is to provide an electric connector assembly comprising a bracket having a partition member defining a space thereunder for accommodating a connector, the space being size to have the partition member abutting against the connector and thus retaining the connector in position during subsequent processing steps.

A further object of the present invention is to provide a connector comprising an insulative housing with first guide posts integrally formed therewith and extending therefrom, metallic grounding/retaining members being attached to the housing with second guide posts integrally formed with and extending from the metallic members.

A further object of the present invention is to provide a method for efficiently and effectively mounting an electric connector assembly comprising at least a coarse pitch connector and a fine pitch connector to a circuit board.

In accordance with a first aspect of the present invention, an electric connector assembly comprises a bracket having a pair of upward-extending arms fixedly receiving a D-sub connector therebetween and a pair of downward-extending legs defining a space for accommodating an ultra-SCSI connector therein. The D-sub connector comprises first conductive pins of a coarse pitch extending beyond a lower face of the bracket. The bracket forms a pair of first guide posts on the lower face thereof for being inserted into corresponding holes defined in a circuit board to properly align the first pins with corresponding apertures defined in the circuit board. The ultra-SCSI connector comprises a plurality of second conductive pins extending beyond the lower face. A pair of metallic projections is fixed to the ultra-SCSI connector and extends beyond the lower face for being received in corresponding holes defined in the circuit board to align the second pins with corresponding apertures defined in the circuit board independent of the bracket and the D-sub connector. The projections of the ultra-SCSI connector have a size greater than board locks of a conventional ultra-SCSI connector thereby being capable to sustain an excessive force in mounting the connector assembly to the circuit board. Furthermore, the projections interferentially engage with the corresponding holes for retaining the ultra-SCSI connector on the circuit board preventing the ultra-SCSI connector from floating during a dipping soldering process.

In accordance with a second aspect of the present invention, the bracket comprises an elongate body having top and lower faces from which the arms and the legs extend respectively. The space defined between the legs has a size receiving the ultra-SCSI connector therein with the ultra-SCSI connector abutting against the lower face of the body thereby being retained in position during subsequent processing steps.

In accordance with a third aspect of the present invention, an ultra-SCSI connector comprises a housing retaining conductive pins having tails extending beyond a lower face of the housing. Primary guide posts are integrally formed with and extend from the lower face of the housing. At least a metallic member is attached to the housing and forms secondary guide posts extending beyond the lower face. The metallic member may electrically shield the pins of the connector or simply functions as retaining means.

In accordance with a fourth aspect of the present invention, a method for mounting an electric connector assembly comprising a bracket accommodating a coarse pitch connector and a fine pitch connector to a circuit board comprises the steps of (1) partially fitting first guide posts of the bracket into corresponding holes of the circuit board for alignment of conductive pins of the coarse pitch connector with corresponding apertures of the circuit board, (2) aligning and fitting at least a second set of guide posts of the fine pitch connector into corresponding holes of the circuit board for guiding alignment of conductive pins of the fine pitch connector with corresponding apertures of the circuit board and (3) further driving the first guide posts of the bracket into the holes of the circuit board for forcing the conductive pins of the coarse pitch connector and fine pitch connector to completely engage with corresponding apertures of the circuit board.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
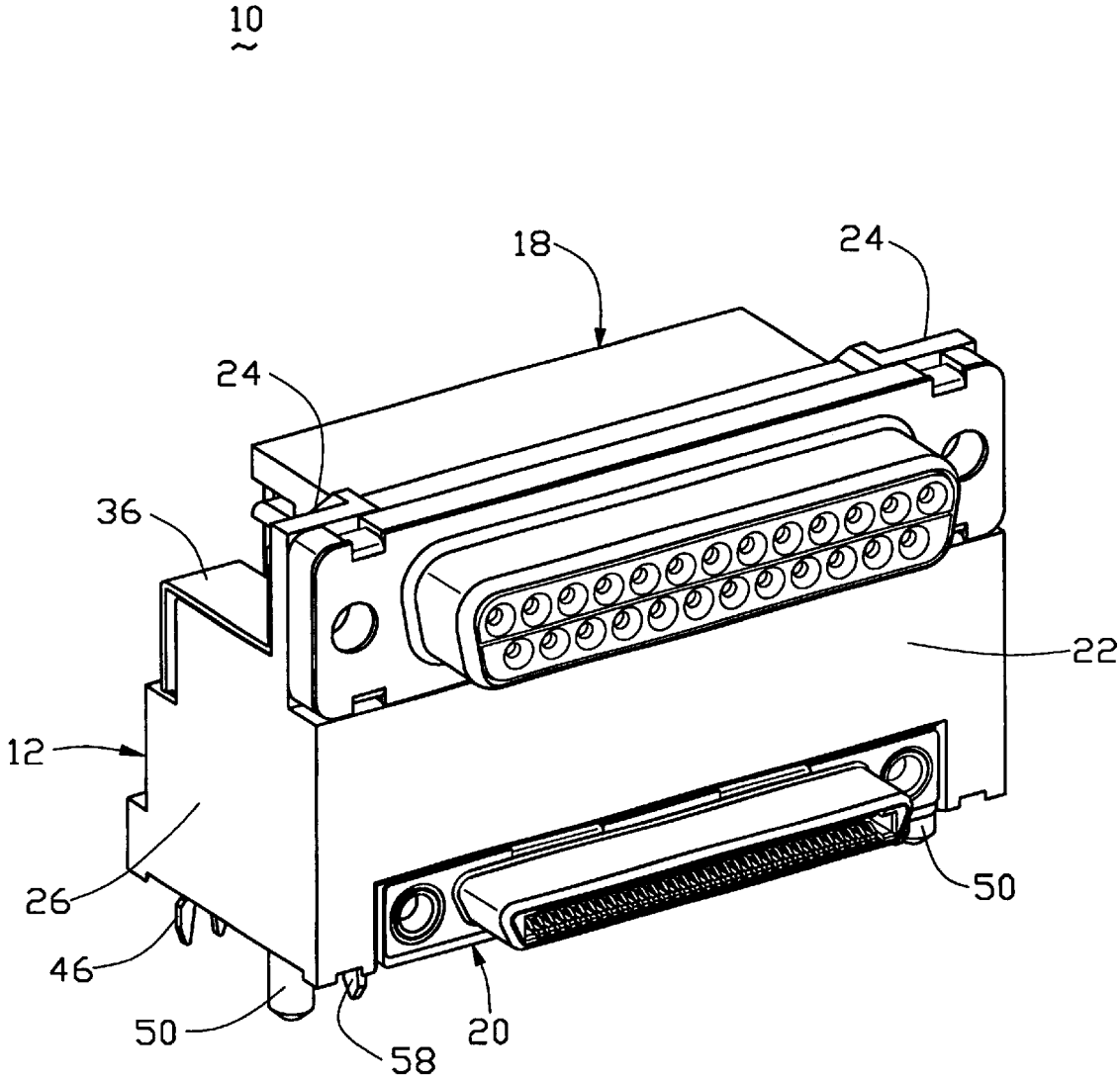
FIG. 1 is a perspective view of an electric connector assembly constructed in accordance with the present invention.
Figure 2:
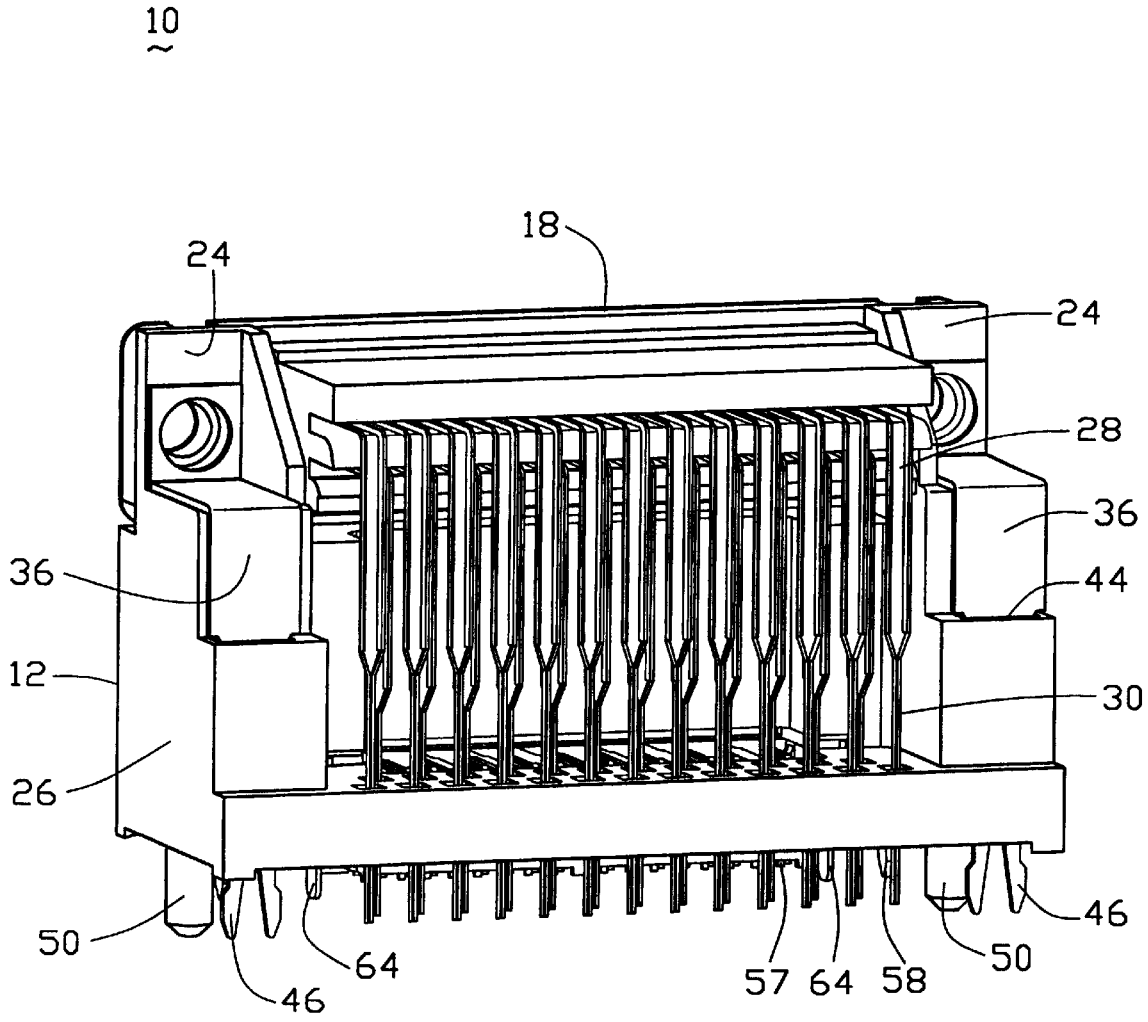
FIG. 2 is another perspective view of the electric connector assembly of the present invention.

Referring to the drawings and in particular to FIGS. 1 and 2, an electric connector assembly 10 constructed in accordance with the present invention comprises a bracket 12 defining upper and lower spaces 14, 16 (FIG. 3) for accommodating first and second connectors 18, 20 which are respectively a coarse pitch connector and a fine pitch connector. In the embodiment illustrated, the coarse pitch connector 18 is a conventional D-sub connector having a pitch of for example 2.54 mm and the fine pitch connector 20 is an ultra-SCSI connector having a pitch of for example 0.8 mm.

Figure 3:
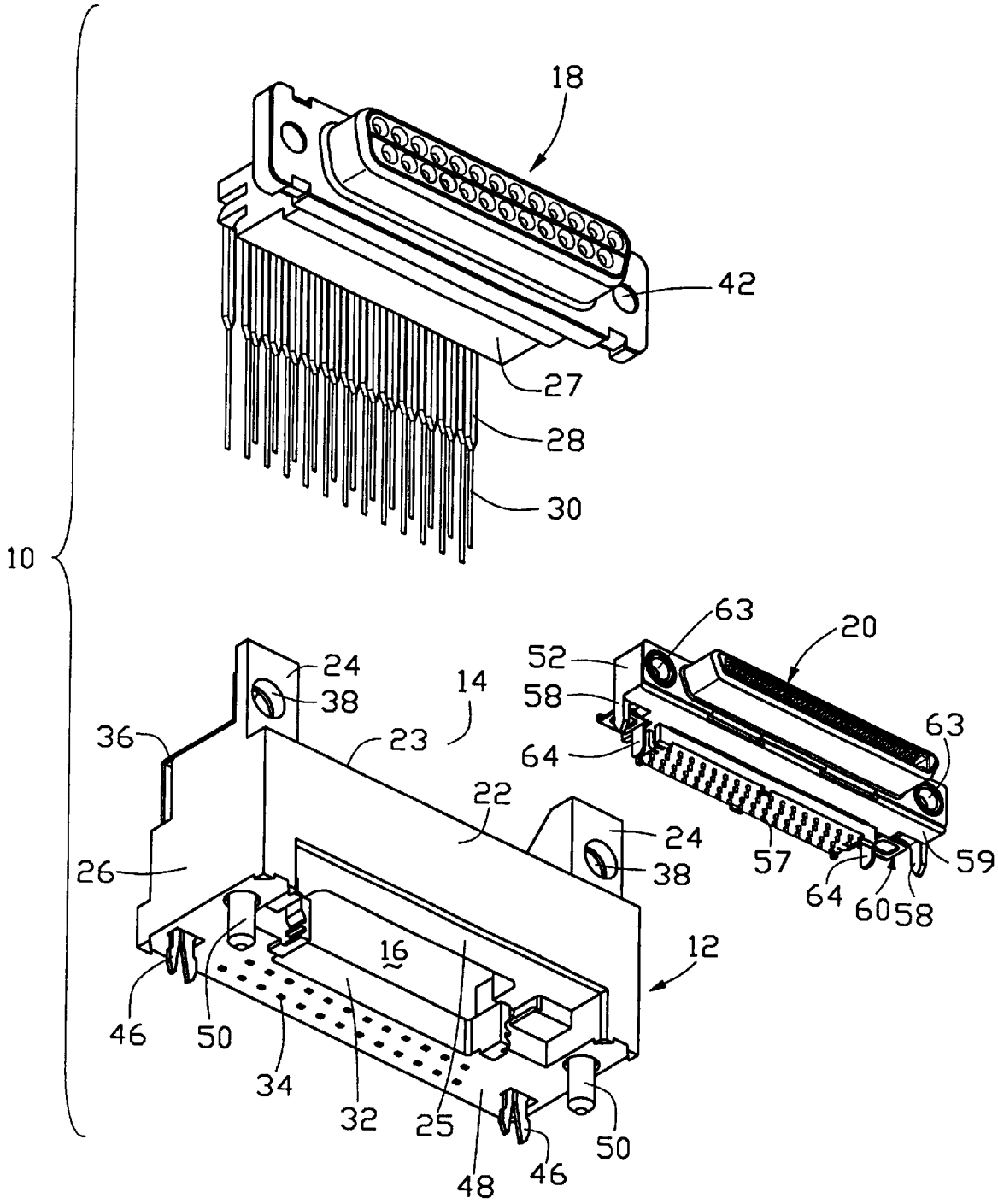
FIG. 3 is an exploded view of the electric connector assembly of the present invention.
Figure 4:
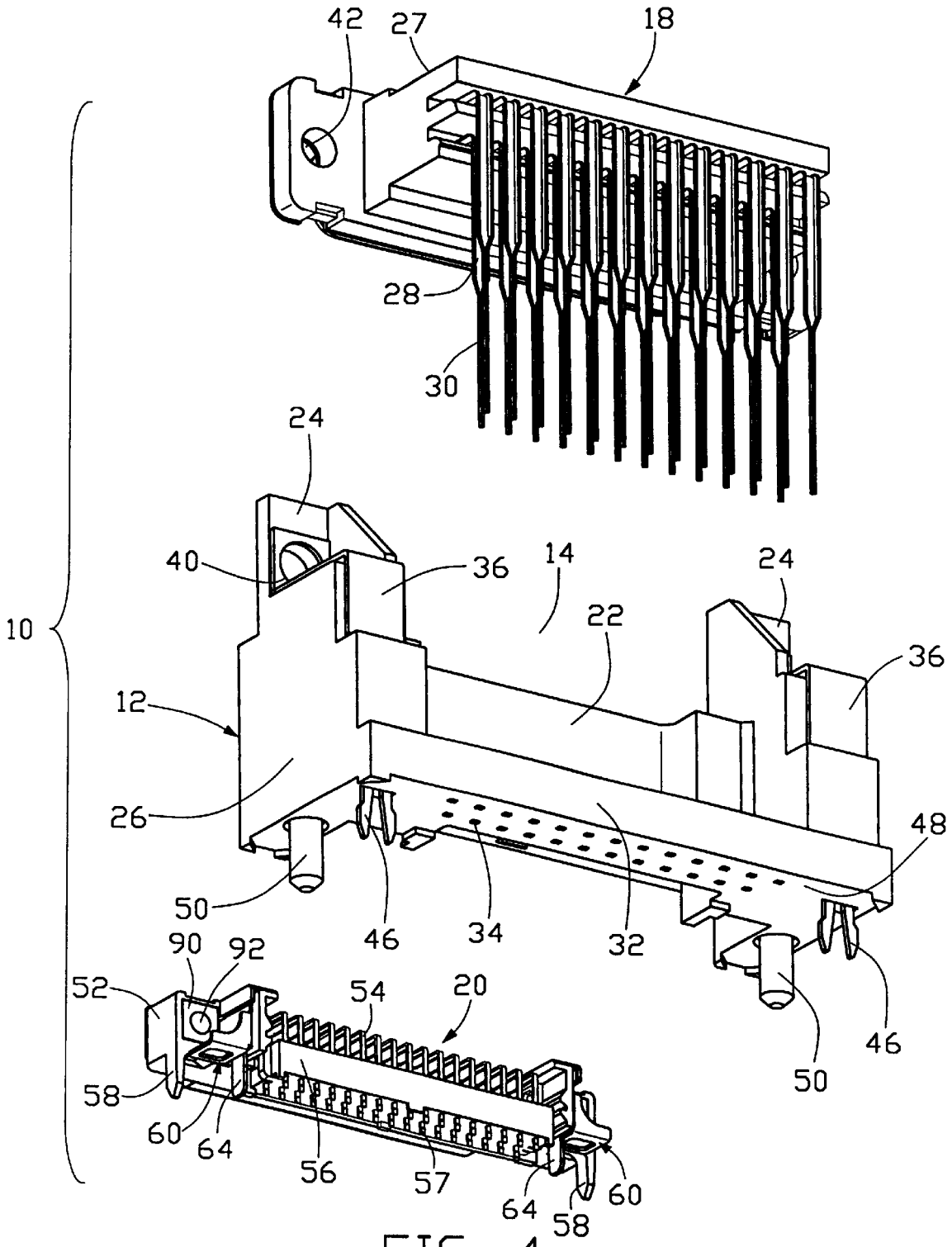
FIG. 4 is another exploded view of the electric connector assembly of the present invention.
Figure 5:
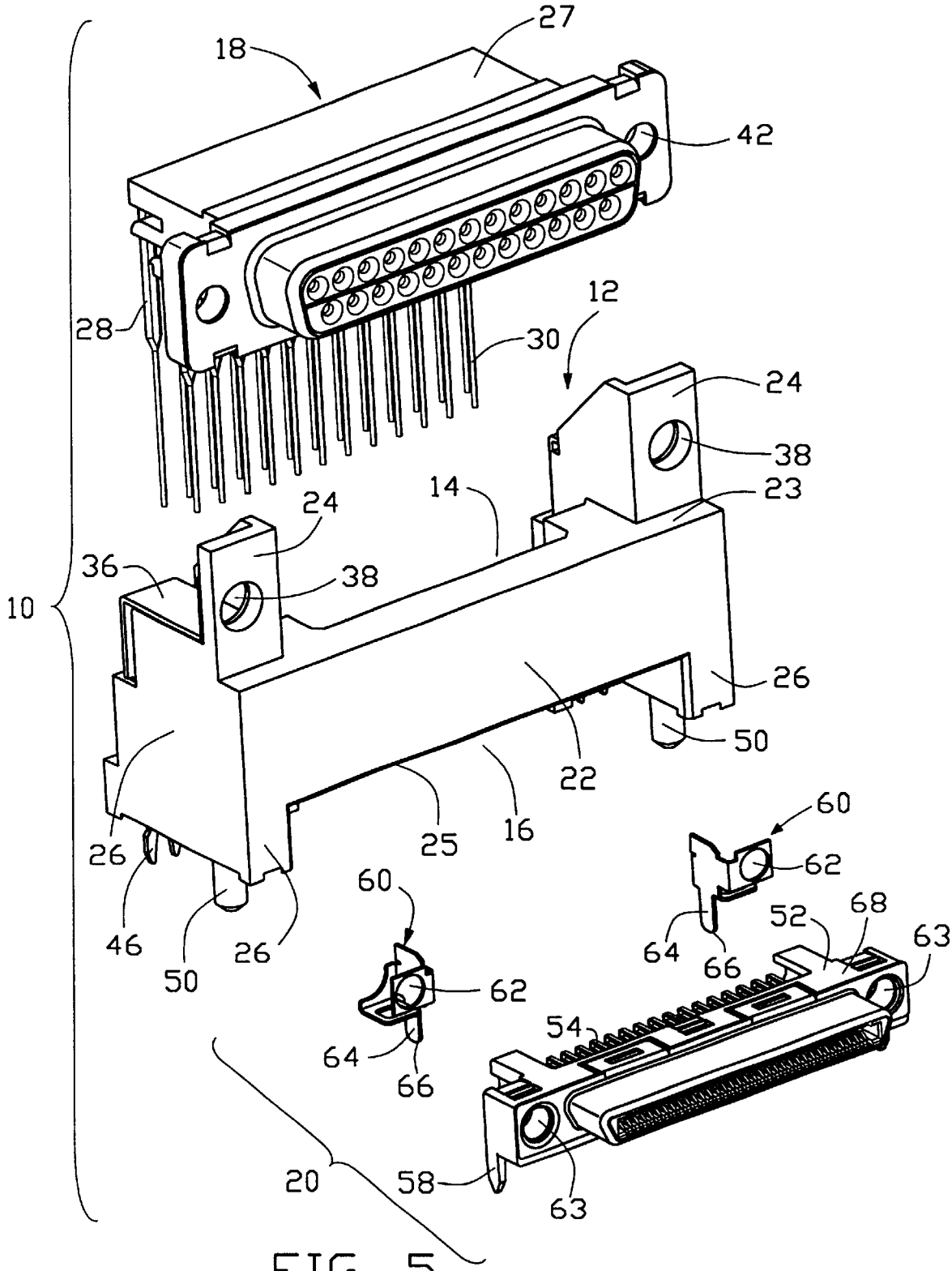
FIG. 5 is a further exploded view of the electric connector assembly.

Also referring to FIGS. 3–5, the bracket 12 comprises an elongate body 22 having upper and lower faces 23, 25 from which a pair of upper arms 24 and a pair of lower legs 26 perpendicularly extend in opposite directions defining the first space 14 and the second space 16 above and below the body 22 for accommodating the first and second connectors 18, 20. The legs 26 have lower free ends forming a lower face 48 of the bracket 12 positionable on a circuit board (not shown).

The first connector 18 comprises an insulative housing 27 retaining a plurality of first conductive pins 28 therein. The first pins 28 have tails 30 extending in a vertical direction beyond the lower face 48 of the bracket 12 for being received in corresponding apertures defined in the circuit board. A spacer 32 is formed between the legs 26 defining a plurality of holes 34 through which the tails 30 of the first pins 28 extend and are thus retained. Board locks 36 are attached to the arms 24 of the bracket 12 by means of fasteners (not shown) received in aligned holes 38, 40 defined in the arms 24 and the board locks 36. Holes 42 are also defined in the housing 27 of the first connector 18 for receiving the fasteners thereby securing the first connector 18 to the bracket 12. Slots 44 are defined in the legs 26 (FIG. 2) through which lower sections of the board locks 36 extend for securely attaching the board locks 36 to the bracket 12. Each board lock 36 has a bifurcated lower end 46 extending beyond the lower face 48 of the bracket 12 for resiliently engaging with corresponding holes defined in the circuit board thereby retaining the bracket 12 on the circuit board.

A pair of first guide posts 50 is integrally formed with the lower face 48 of the bracket 12 and extending therefrom to be received in corresponding holes defined in the circuit board for guiding and aligning the tails 30 of the first pins 28 of the first connector 18 with corresponding apertures defined in the circuit board.

The second connector 20 is received in the second space 16 with a lower face 59 (FIG. 3) thereof substantially flush with the lower face 48 of the bracket 12 and thus being positionable on the circuit board. The second connector 20 comprises an insulative housing 52 retaining a plurality of second conductive pins 54 therein. The second pins 54 are arranged to have a pitch much smaller than a pitch of the first pins 28. The housing 52 forms a spacer 56 defining a plurality of through holes (not labeled) for receiving and retaining tails 57 of the second pins 54. A pair of second guide posts 58 is integrally formed with and extends from the housing 52 beyond the lower face 59 thereof. A pair of metal retaining members 60 is attached to the housing 52 of the second connector 20 by means of fasteners 90 (FIG. 4, only one shown) each of which has a shaft portion fittingly extending through a hole 62 defined in one retaining member 60 and a corresponding hole 63 defined in the housing 52.

Each retaining member 60 forms a projection 64 extending beyond the lower face 59 of the second connector 20. The projection 64 has a rounded free end 66 for facilitating insertion thereof into a corresponding hole defined in the circuit board. Thus, besides the second guide posts 58, the second connector 20 comprises further guiding means (the projections 64 of the metal retaining members 60) for guiding and aligning the second pins 54 of the second connector 20 with corresponding apertures defined in the circuit board. The metal projections 64 have an enlarged size as compared with board locks of a conventional ultra-SCSI connector whereby the metal projections 64 are strong enough to sustain the force for mounting the connector assembly, especially the coarse pitch connector 18, to the circuit board. The second pins 54 may thus be guided to properly align with the corresponding apertures of the circuit board by the projections 64 independent of the first connector 18 and the bracket 12.

Furthermore, the retaining members 60 may be in electric connection with a shielding member of the second connector 20 that electrically shields the second pins 54 whereby an additional grounding path may be provided with the projections 64 grounded via the circuit board. If desired, the retaining members 60 may be integrally formed with the shielding member Furthermore, the projections 64 are large enough to interferentially engage the corresponding holes of the circuit board for retaining the second connector 20 on the circuit board whereby when the circuit board is subject to dipping soldering for soldering the first and second connectors 18, 20 thereto, the interferential engagement between the projections 64 and the corresponding holes of the circuit board maintains the second connector 20 in position, preventing the second connector 20 from being floated by the liquid soldering material.

Preferably, the second connector 20 is sized to have an upper face 68, opposite the lower face 59, abutting against the lower face 25 of the body 22 of the bracket 12 for facilitating retention of the second connector 20 in position during subsequent processing steps.

By this way, due to the provision of the metal projections 64, which are enlarged in size as compared to the board locks of the conventional ultra-SCSI connector, the second connector 20 may be smoothly mounted to the circuit board substantially independent of the bracket 12 and the first connector 18 whereby the second pins 54 which are much thinner than the first pins 28 can be precisely aligned with corresponding apertures of the circuit board without being damaged in the mounting process. Furthermore, the projections 64 of the retaining members 60 provide means for retaining the second connector to the circuit board independent of the bracket thereby facilitating fixing the second connector in position during a dipping soldering process.

A method for mounting the connector assembly 10 of the present invention to a circuit board would comprise the following general steps:

(1) Aligning the guide posts 50 of the bracket 12 with the corresponding holes defined in the circuit board;

(2) Slightly inclining the connector assembly 10 forward, for example approximately 2 degrees, for ensuring the guide posts 58 and the projections 64 of the second connector 20 slightly fit into the corresponding holes of the circuit board thereby aligning and then slightly fitting the tails 57 of the second pins 54 into the corresponding apertures of the circuit board;

(3) Based on the second connector 20 aligning with the circuit board, aligning and forcibly fitting the bifurcated lower ends 46 of the board locks 36 and the tails 30 of the first pins 28 into the corresponding holes/apertures of the circuit board; and (4) Finally, completely fitting the tails 30, 57 of the first and second pins 28, 54, the guide posts 50, 58, the projections 64 and the lower ends 46 of the board locks 36 into the corresponding holes/apertures of the circuit board to complete mounting the connector assembly 10 to the circuit board.

Although the present invention has been described with reference to the preferred embodiment, it is apparent to those skilled in the art that a variety of modifications and changes may be made without departing from the scope of the present invention which is intended to be defined by the appended claims.

What is claimed is:

1. An electric connector assembly comprising:

a bracket comprising an elongate body forming upward-extending arms and downward-extending leg in opposite directions respectively defining first and second spaces above and below the body, the bracket having a lower face adapted to be positioned on a circuit board;

a first connector fixedly received in the first space above the elongate body of the bracket, comprising an insulative housing retaining conductive first pins therein, the first pins being arranged at a coarse first pitch and having tails extending beyond the lower face of the bracket for being received in corresponding apertures defined in the circuit board; and a second connector received in the second space below the body of the bracket, the second connector comprising an insulative housing retaining a plurality of conductive second pins therein, the housing of the second connector having a lower face substantially corresponding to the lower face of the bracket, the second pins being arranged at a fine second pitch much smaller than the first pitch and having tals extending beyond the lower face of the second connector for being received in corresponding apertures defined in the circuit board, a pair of holes being defined at opposite ends of the insulative housing;

wherein the bracket comprises first guide posts extending beyond the lower face thereof adapted to be inserted into corresponding holes defined in the circuit board for properly positioning the connector assembly on the circuit board, the second connector comprises metallic members fixed to the housing thereof and each metallic member forms projections extending beyond the lower face of the housing of the second connector, and a fastener fittingly extends through a hole defined in each of the metallic members and a corresponding one of the pair of holes at opposite ends of the housing of the second connector to fix the metallic members to the housing of the second connector, the projections having a size sufficient to effectively and durably guide the alignment of the tails of the second pins with the corresponding apertures of the circuit board independent of the first connector and the bracket;

wherein the projections are for being interferentially engageable with holes defined in the circuit board for retaining the second connector on the circuit board;

wherein the first connector is a D-sub connector and the second connector is an ultra-SCSI connector;

wherein the metallic members function to electrically shield the second pins;

wherein the housing of the second connector has an upper face abutting against the body of the bracket;

wherein the bracket comprises board locks attached thereto for retaining the connector assembly on the circuit board;

wherein the second connector has no board lock thereof while including a pair of second guide posts integrally extending downwardly from two opposite ends of the housing of the second connector and beyond the lower face thereof for being received in holes defined in the circuit board, and the projections positioned between said pair of second guide posts;

wherein the holes of the metallic member are aligned with corresponding holes in the housing of the second connector for extension of the corresponding fastener therethrough while being not aligned with holes defined in the upward-extending arms of the bracket.

* * * * *